US009834402B2

(12) United States Patent
Sachs

(10) Patent No.: US 9,834,402 B2
(45) Date of Patent: Dec. 5, 2017

(54) METHOD AND DEVICE FOR HANDLING SANITARY ARTICLES

(71) Applicant: Focke & Co. (GmbH & Co. KG), Verden (DE)

(72) Inventor: Frank Sachs, Saterland (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 14/434,166

(22) PCT Filed: Oct. 10, 2013

(86) PCT No.: PCT/EP2013/003050

§ 371 (c)(1),
(2) Date: Apr. 8, 2015

(87) PCT Pub. No.: WO2014/063788

PCT Pub. Date: May 1, 2014

(65) Prior Publication Data

US 2015/0284210 A1 Oct. 8, 2015

(30) Foreign Application Priority Data

Oct. 23, 2012 (DE) ..... 10 2012 110 101

(51) Int. Cl.
*B65G 43/00* (2006.01)
*B65H 39/00* (2006.01)
(Continued)

(52) U.S. Cl.
CPC ..... *B65H 39/00* (2013.01); *B65B 5/067* (2013.01); *B65B 35/50* (2013.01); *B65B 57/14* (2013.01);
(Continued)

(58) Field of Classification Search
CPC ..... B65H 39/00; B65H 35/50; B65H 3/128; B65H 3/124; B65G 59/02; B65G 59/026; B65B 5/067; B65B 57/14
(Continued)

(56) References Cited

U.S. PATENT DOCUMENTS 3,545,631 A * 12/1970 Chivas ..... B65G 21/2036 271/12
3,830,489 A * 8/1974 Adams ..... B65H 3/126 156/299
(Continued)

FOREIGN PATENT DOCUMENTS

DE 1511849 A1 1/1970
DE 3629561 A1 3/1988
(Continued)

OTHER PUBLICATIONS

Deutsches Patent—Und Markenamt, Recherchebericht (German Patent Office Search in related application), dated Oct. 1, 2013.
(Continued)

*Primary Examiner* — William R Harp
(74) *Attorney, Agent, or Firm* — Laurence P. Colton; Smith Tempel Blaha LLC

(57) ABSTRACT

A method for handling (flat) objects (10), in particular sanitary articles such as diapers, sanitary napkins or the like, wherein the objects (10) are conveyed along a transport section (12) in a product flow and are then put together in a grouping station to form groups of objects (10). The objects (10) are introduced into the product flow in the region of an inlet station (23) before the objects (10) are put together to form groups.

14 Claims, 10 Drawing Sheets

(51) Int. Cl.

| | |
|---|---|
| ***B65B 57/14*** | (2006.01) |
| ***B65H 39/02*** | (2006.01) |
| ***B65H 1/26*** | (2006.01) |
| ***B65H 3/12*** | (2006.01) |
| ***B65B 5/06*** | (2006.01) |
| ***B65B 35/50*** | (2006.01) |

(52) U.S. Cl.
CPC ..... *B65H 1/26* (2013.01); *B65H 3/128* (2013.01); *B65H 39/02* (2013.01); *B65H 2301/4451* (2013.01); *B65H 2301/4454* (2013.01); *B65H 2301/44734* (2013.01); *B65H 2402/31* (2013.01); *B65H 2404/2615* (2013.01); *B65H 2404/2693* (2013.01); *B65H 2405/352* (2013.01); *B65H 2405/36* (2013.01); *B65H 2406/323* (2013.01); *B65H 2701/1924* (2013.01)

(58) Field of Classification Search
USPC ..... 198/357, 418–433, 443, 459.1, 198/459.8–462.3; 414/797, 796.5, 796.7, 414/797.2
See application file for complete search history.

(56) References Cited

U.S. PATENT DOCUMENTS

| | | | | | |
|---|---|---|---|---|---|
| 4,238,025 | A | | 12/1980 | Manservisi | |
| 4,635,921 | A | * | 1/1987 | Thomas | B65H 3/14 221/211 |
| 4,792,033 | A | * | 12/1988 | Iwata | B65G 43/08 198/357 |
| 6,805,528 | B2 | * | 10/2004 | Monti | B65B 35/04 414/796.7 |
| 7,665,721 | B2 | * | 2/2010 | Palamides | B65H 29/6618 271/9.01 |
| 8,583,279 | B2 | * | 11/2013 | Fecht | B65B 35/44 198/347.1 |
| 2004/0048727 | A1 | | 3/2004 | Roozrokh | |
| 2010/0138035 | A1 | * | 6/2010 | Fecht | B65B 35/44 700/228 |

FOREIGN PATENT DOCUMENTS

| | | | |
|---|---|---|---|
| DE | 3830692 | A1 | 3/1990 |
| DE | 102006011642 | A1 | 9/2007 |
| DE | 102008036564 | A1 | 2/2010 |
| EP | 0273288 | A2 | 7/1988 |
| EP | 0565019 | A1 | 10/1993 |
| EP | 1325867 | A1 | 7/2003 |
| JP | H06154918 | A | 6/1994 |

OTHER PUBLICATIONS

WIPO, International Search Report (in parent application), dated Jan. 23, 2014.

State Intellectual Property Office of The People's Republic of China, Notification of the First Office Action (for related China Patent Application No. 201380065710.6 (dated Mar. 3, 2016).

Studio Torta, Remarks Concerning the Patentability of European Patent Application 13779732.0 (remarks submitted by a competitor company during the prosecution of a related application), Apr. 21, 2016.

* cited by examiner

METHOD AND DEVICE FOR HANDLING SANITARY ARTICLES

STATEMENT OF RELATED APPLICATIONS

The application is the US PCT National Phase of International Application No. PCT/EP2013/003050 having an International Filing Date of 10 Oct. 2013, which claims priority on German Patent Application No. 10 2012 110 101.9 having a filing date of 23 Oct. 2012.

BACKGROUND OF THE INVENTION

Technical Field

The invention relates to a method for handling (flat) objects, in particular sanitary articles such as diapers, sanitary napkins or the like, wherein the objects are conveyed along a transport section in a product flow and are then put together in a grouping station to form groups of objects.

In addition, the invention relates to a corresponding device for handling (flat) objects, in particular sanitary articles such as diapers, sanitary napkins or the like, said device having a transport section for transporting the objects in a product flow in the direction of a grouping station for forming groups of objects.

Prior Art

Numerous variants of the methods and devices of the type mentioned in the introduction are known in practice. The problem in this case is articles being supplied subsequently to the group. This can be necessary if individual objects have been removed from the packaging flow for testing purposes or if individual objects have proved to be faulty in a possible test and have been discarded. As a rule, it is necessary to replace said objects. In addition, it can be desirable to add objects to the group which differ in one or several features from the remaining objects. Both these things are currently only possible manually or they are not possible at all.

BRIEF SUMMARY OF THE INVENTION

Proceeding from this point, the object underlying the invention is to develop further methods and devices of the type mentioned in the introduction, in particular with regard to adding or supplying objects automatically in as simple a manner as possible.

To achieve said object, a method according to the invention is a method for handling (flat) objects (10), in particular sanitary articles such as diapers, sanitary napkins or the like, wherein the objects (10) are conveyed along a transport section (12) in a product flow and are then put together in a grouping station to form groups of objects (10), characterized in that objects (10) are introduced into the product flow in the region of an inlet station (23) before the objects (10) are put together to form groups. It is accordingly provided that objects are introduced into the product flow in the region of an inlet station before the objects are put together to form groups.

Said solution enables objects to be supplied in a comfortable subsequent manner into the product flow. Manual addition is not necessary. Thus, the objects can be put together in a simple manner in the region of the grouping station to form a group corresponding to the pack format without at the same time having to consider missing objects in the product flow. It is also possible to supply different objects, for example as additional packaging, in a simple manner.

According to a preferred further development of the invention, it is provided that the objects are made available in a hopper in the region of the inlet station and are removed from the said hopper and introduced into the product flow, wherein the objects are preferably removed from the top of the hopper which is situated below the transport section. The objects are preferably moved upward in the hopper by means of a lifting device, wherein the lifting device is controlled by a control unit in dependence on the thickness of the objects.

According to a preferred embodiment of the invention, it is provided that a device for removing the objects from the hopper, in particular a suction belt, is arranged in the region of the inlet station above the hopper or above a removal opening of the hopper, wherein to remove in each case one object from the hopper the removal device is lowered at least in part by means of an adjusting device and after removal is raised again. This enables objects to be supplied in a targeted manner to the product flow. If the removal device is not lowered, the product flow is able to run unaffected through the inlet station.

A further characteristic can be that several hoppers are associated with one conveying device, in particular an endless conveyor with receiving means for a plurality of hoppers, and are moved one after another into the region of the inlet station and there are emptied by introducing the products from the hopper into the product flow. This enables a large number of objects to be introduced automatically without interrupting production for the purposes of a change in hopper.

A device according to the invention for achieving the object mentioned is a device for handling (flat) objects (10), in particular sanitary articles such as diapers, sanitary napkins or the like, said device having a transport section (12) for transporting the objects (10) in a product flow in the direction of a grouping station for forming groups of objects (10), characterized in that an inlet station (23) for introducing objects (10) into the product flow is provided along the transport section (12) and at a spacing from the grouping station. Accordingly, an inlet station for introducing objects into the product flow is provided along the transport section and at a spacing from the grouping station.

As regards design, a hopper can be provided for the objects in the region of the inlet station, from the top of which hopper said objects are removable, and that a lifting device is provided for transporting the objects inside the hopper, wherein the hopper is closed in part at the top by a cover and a removal opening for objects is formed outside the cover and wherein the cover and/or the objects are preferably arranged at a slight angle. The cover, which can extend, for example, over ¾ of the hopper, prevents the objects being able to escape in an uncontrolled manner from the hopper. As a result of the slight angle of the objects and/or of the cover, it is only possible to remove the topmost object in each case reliably from the hopper in a controlled manner.

A further characteristic can be that several hoppers are associated with one conveying device and are transportable one after another into the inlet station for emptying the hoppers, wherein an intermediate hopper is arranged in the inlet station above the hopper, wherein the objects are initially transportable by the lifting device into the region of the intermediate hopper and wherein the objects can be supplied to the removal device from the intermediate hopper by means of a further lifting device whilst the empty hopper is replaced by a filled hopper. A continuous supply of objects in the inlet station can be ensured in this manner.

Another advantageous detail of the device is that the hoppers can be tested by means of a testing device for the presence of objects, wherein the conveying device is controllable in such a manner by means of a control unit that only hoppers with objects are held ready in the inlet station.

An advantageous characteristic of the hopper can be that the hoppers are releasably fastenable on the conveying device for filling with objects, in particular for cleaning and/or filling with objects and/or stocking outside the conveying device.

BRIEF DESCRIPTION OF THE DRAWINGS

Preferred exemplary embodiments of the invention are explained below by way of the drawing, in which.

DETAILED DESCRIPTION OF PREFERRED EMBODIMENTS

Figure 1:
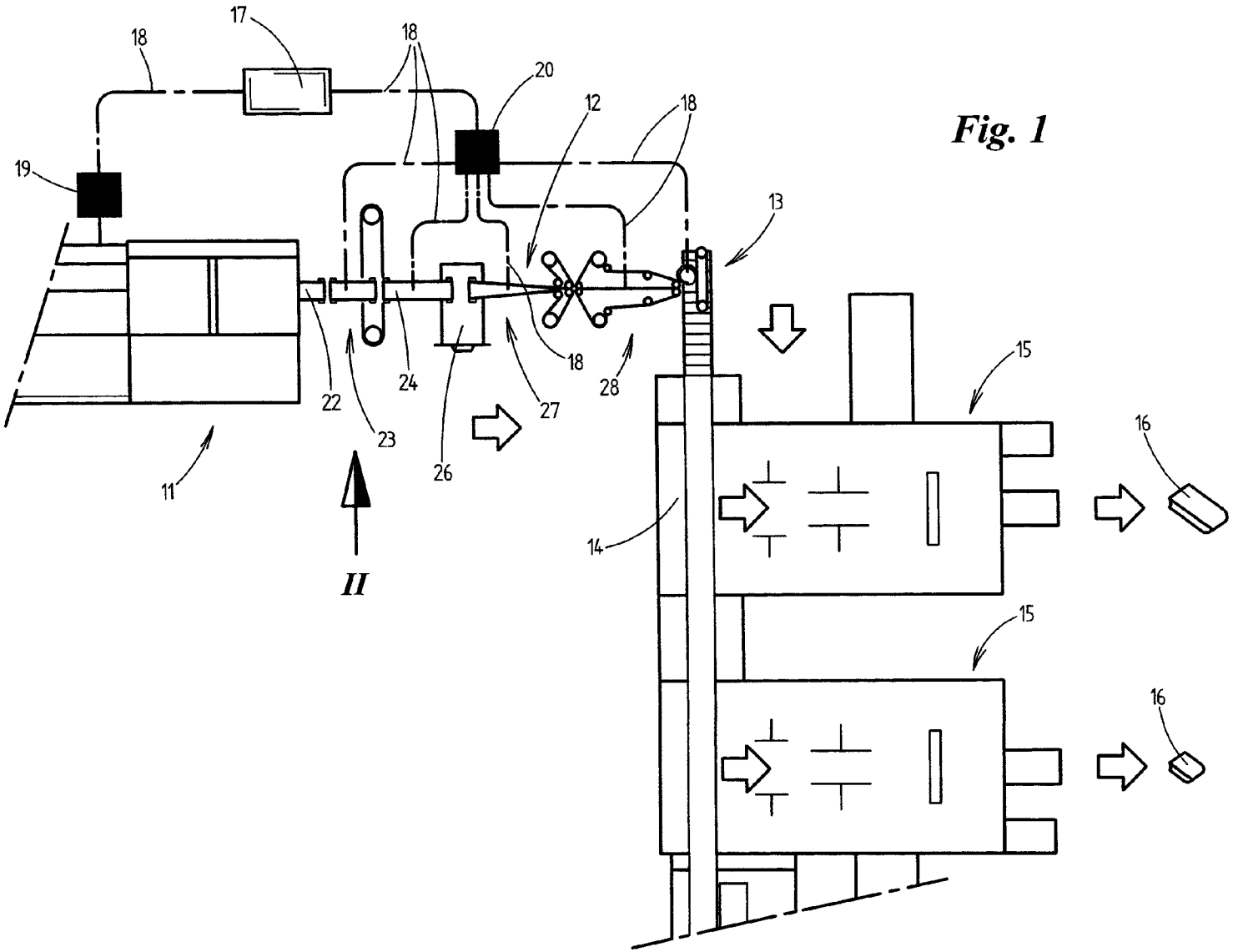
FIG. 1 shows a schematic top view of a production facility for sanitary products.

The invention is described below by way of a device for grouping objects 10. The objects 10 can be sanitary products such as diapers, sanitary napkins or the like. In the present case the objects 10 comprise a flat shape. It is naturally also conceivable to use the device with other products.

The objects 10 are transported from a converter 11 along a transport section 12 and are transferred to a further feed conveyor 14 by a filling member 13. The feed conveyor 14 runs past two packaging machines for wrapping groups 14 of objects 10 in (foil) bags 16. By means of pushing devices (not shown), groups can be supplied in a selective manner to the one or other packaging machine 15. The groups can also be conveyed past the packaging machines 15 in a selective manner into the region of a packaging machine (not shown) for collapsible boxes or into the region of a packaging machine (not shown) for sealed packaging.

Figure 2:
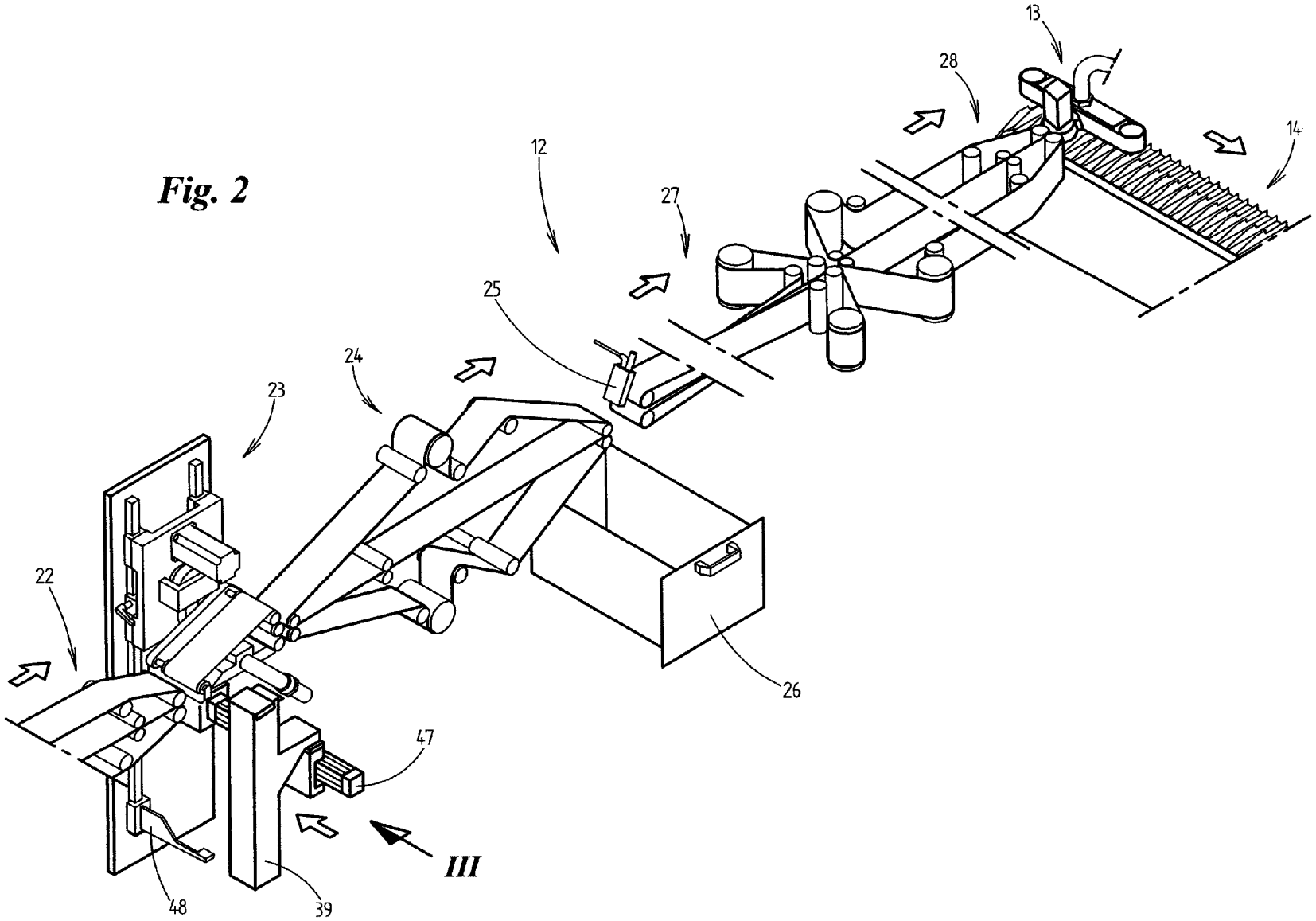
FIG. 2 shows a schematic three-dimensional representation of a transport section of the production facility according to arrow II in FIG. 1.

FIG. 2 shows a detail of the transport section 12 which serves for transporting the objects 10 from the converter 11 to the filling member 13. Several conveying members and other devices are provided in the region of the transport section 12 and are described in detail below:

coming from the converter 11, the objects 10 are transported initially between conveyor runs of a first conveyor 22. Following the conveyor 22, the objects 10 run through an inlet station 23 which serves for supplying or introducing objects 10 into the transport section 12. A further conveyor 24 follows the inlet station 23. An ejection station follows this, of which only an ejection unit 25 and a collecting container 26 are shown. Following this is a next conveyor 27 for rotating or aligning the objects 10. Following this in turn is a last conveyor 28 which supplies the objects 10 to the filling member 13. The filling member 13 serves for pushing objects 10 into compartments of the feed conveyor 14. The device is controlled by a central control unit 17 which is connected via control lines 18 to a machine control means 19 for the converter 11 and to a control device 20 for the conveyors 22, 24, 27 and 28. The inlet station 23 and the ejection unit 25 can also be controlled by the central control unit 17 or the control device 20. It is also conceivable for the control unit 17 and/or the machine control means 19 and/or the control device 20 to be incorporated in one device.

Figure 3:
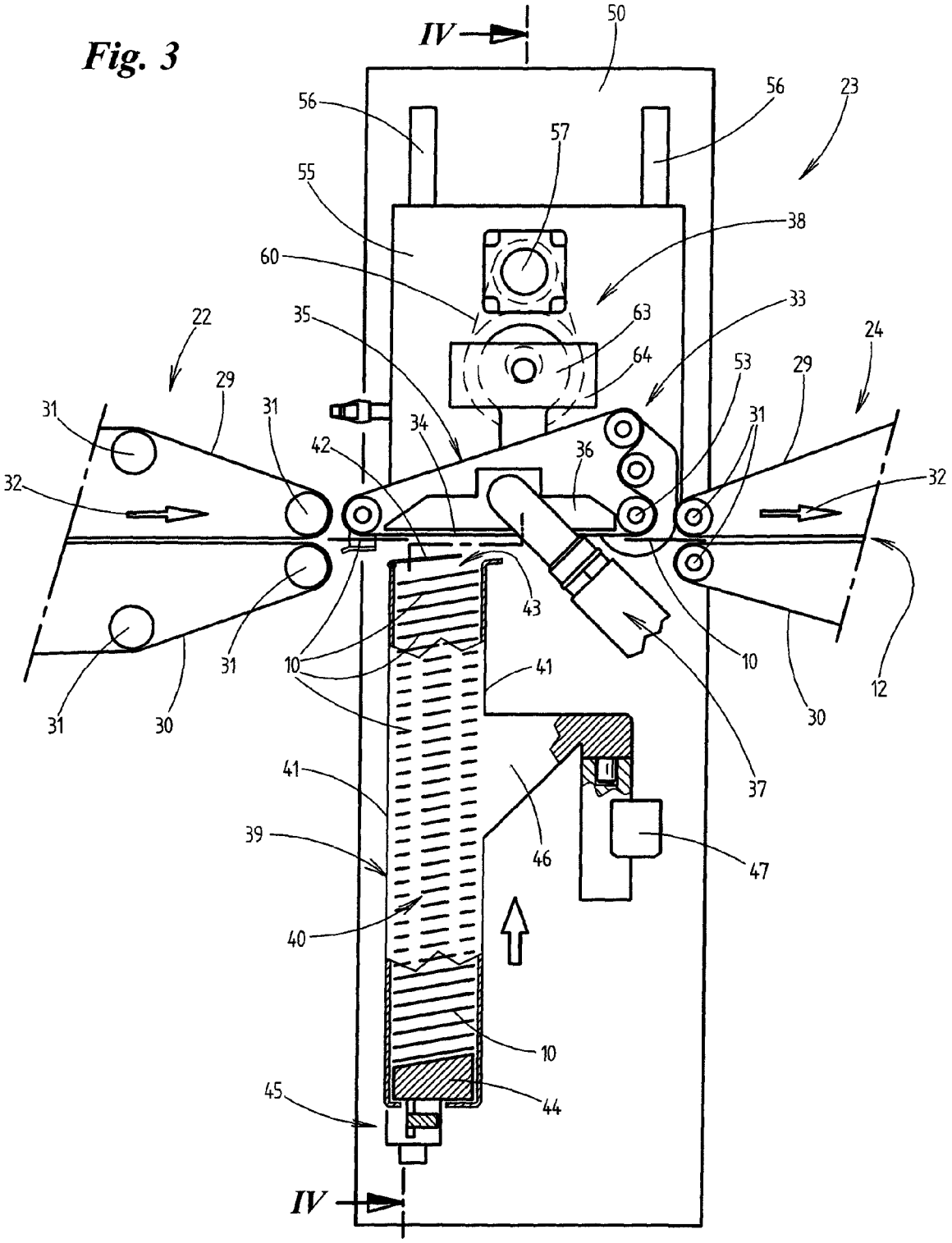
FIG. 3 shows a side view of a detail of the transport section in the region of an inlet station for the sanitary products.

FIG. 3 shows a vertical section through the transport section 12 in the region of the inlet station 23. The objects 10 are conveyed along the transport section 12 in a packaging flow. A packaging flow is to be understood in the present case as the objects 10 being transported one after another in the plane of the transport section 12. In the exemplary embodiment shown, the objects 10 are arranged lying flat and in each case at a spacing from the next object 10. The size of the spacing between consecutive objects can differ, for example according to the conveying speed or other defaults.

The two conveyors 22, 24 are realized in each case as a pair of endless conveyors, the conveyor runs 29, 30 of the same being guided by means of guide rollers 31. The objects 10 are conveyed in the transport direction according to arrow 32 lying flat between the conveyor runs 29, 30 which face one another in each case.

The spacing between the conveyors 22, 24 is bridged by a further conveying member of the inlet station 23. In this case, this is a conveyor 33 which is also realized as an endless conveyor and is guided by means of guide rollers 31 such that a bottom conveyor run 34 runs along the transport section 12. Said conveyor run 34 is acted upon with a negative pressure such that the objects 10 are held on the bottom surface of the conveyor run 34 in the region of the conveyor 33. The conveyor 33 is therefore realized in the present case as a suction belt 35, a negative pressure being generated in the region of the conveyor run 34 to hold the objects 10 by means of a vacuum chamber 36, which is connected to a vacuum source (not shown) by a vacuum connection 37. At the same time, the conveyor 33 is also part of a removal device 38 which serves for the purpose of removing individual objects 10 from a hopper 39 which is arranged in the inlet station 23 below the conveyor 33 or below the transport section 12.

In the hopper 39 the objects 10 are arranged lying flat one on top of another in a stack 40. The objects 10 are supported at the side by vertical walls 41 of the hopper 39. The hopper 39 comprises a cover 42 at the top. The cover 42 does not extend over the entire top surface of the hopper 39 such that a removal opening 43 is formed in the remaining region. The size of the cover 42 preferably corresponds to a large part of the top surface of the hopper 39, in particular to approximately ¾ of said surface.

Inside the stack 40 the objects 10 are arranged at a slight angle, namely ascending in the conveying direction according to arrow 32. The cover 42 comprises a corresponding inclination. In the present case, the angle of the objects 10 is obtained as a result of the bottommost object 10 in the hopper 39 resting on an inclined surface. In the exemplary embodiment shown, in this case this is a top surface of a lifting part 44. The lifting part 44 is part of a lifting unit 45 for transporting the objects in the direction of the removal opening 43.

In addition, the hopper 39 is mounted so as to be displaceable transversely with respect to the transporting direction according to arrow 32. To this end, the hopper 39 is mounted on a pneumatic cylinder 47 by means of a support arm 46 and can be moved in the longitudinal direction of the pneumatic cylinder 47, as indicated in FIG. 4.

Figure 4:
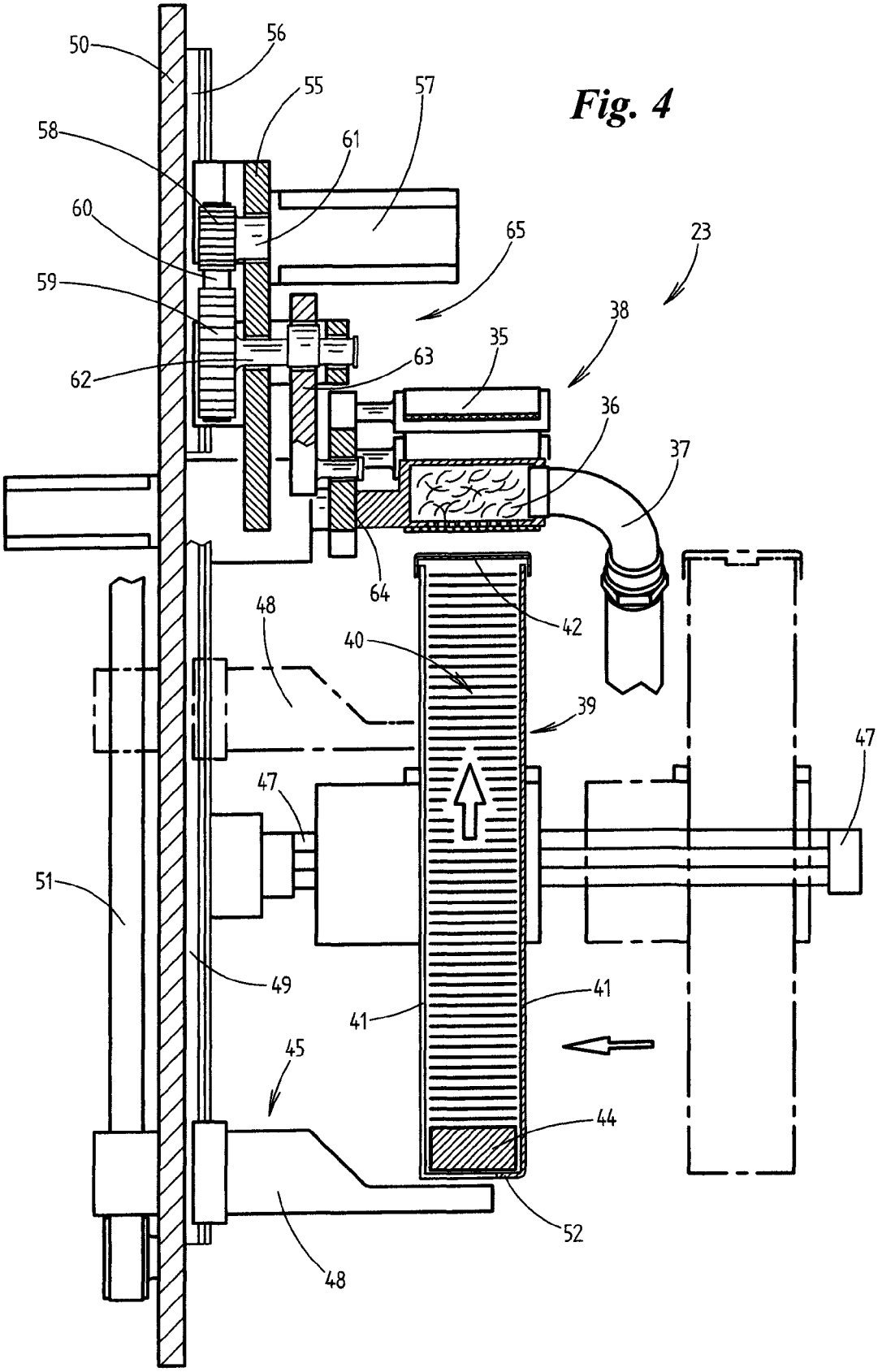
FIG. 4 shows a vertical section through the inlet station according to the line of intersection IV-IV in FIG. 3.

FIG. 4 shows the design of the lifting device 45 particularly well. A lifting arm 48 is mounted on a vertical upright rail 49 so as to be movable in a corresponding direction. The running rail 49 is mounted in turn on a support wall 50. A toothed belt 51 runs at the rear of the support wall 50 for driving the lifting arm 48. The lifting arm 48 reaches through walls of the hopper 39, namely through corresponding recesses in the region of a bottom wall 52 and a (side) wall 41 of the hopper 39 which faces the support wall (50).

Figure 5:
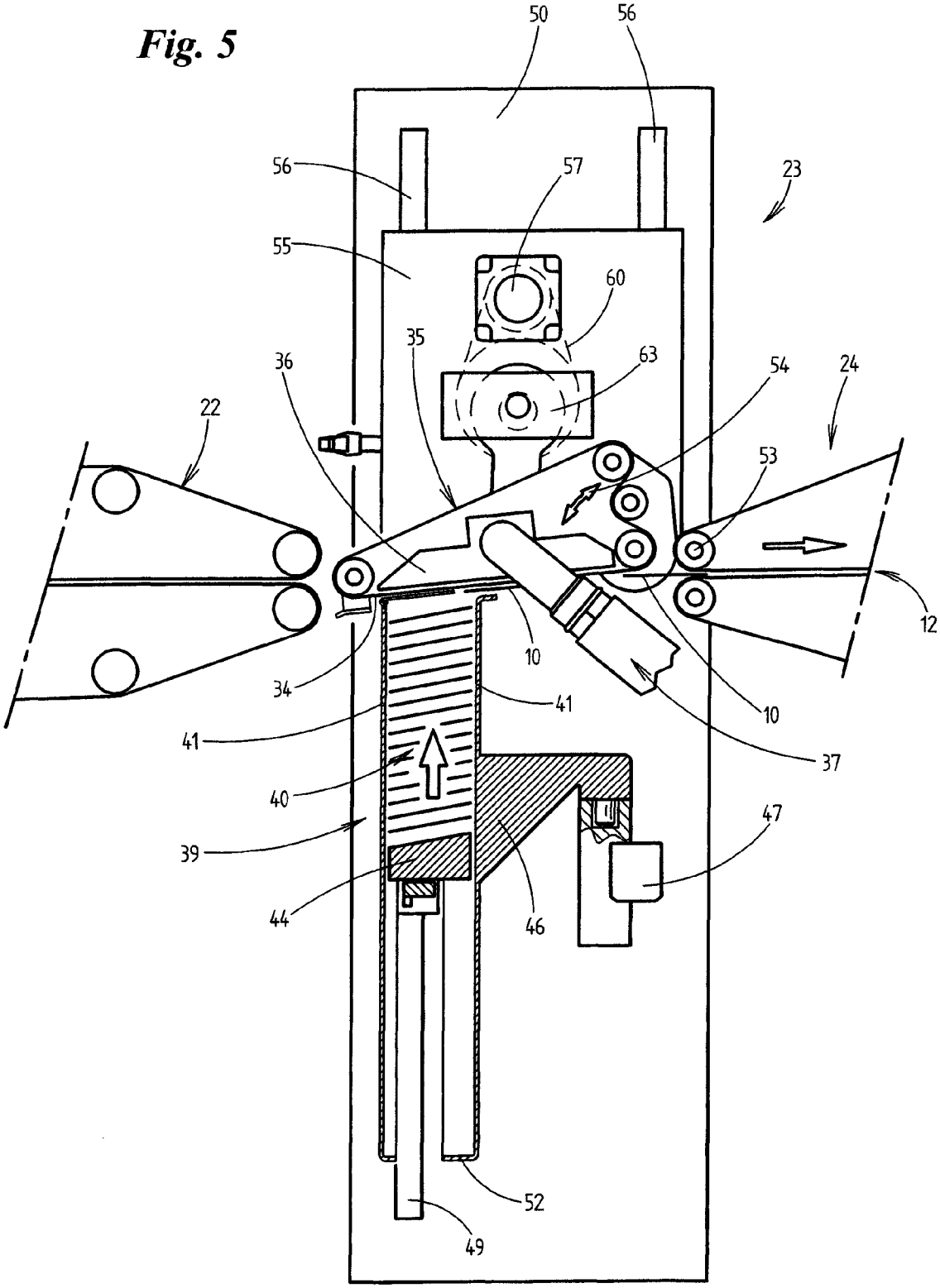
FIG. 5 shows a side view analogous to FIG. 3 of the inlet station when the sanitary products are being introduced.
Figure 6:
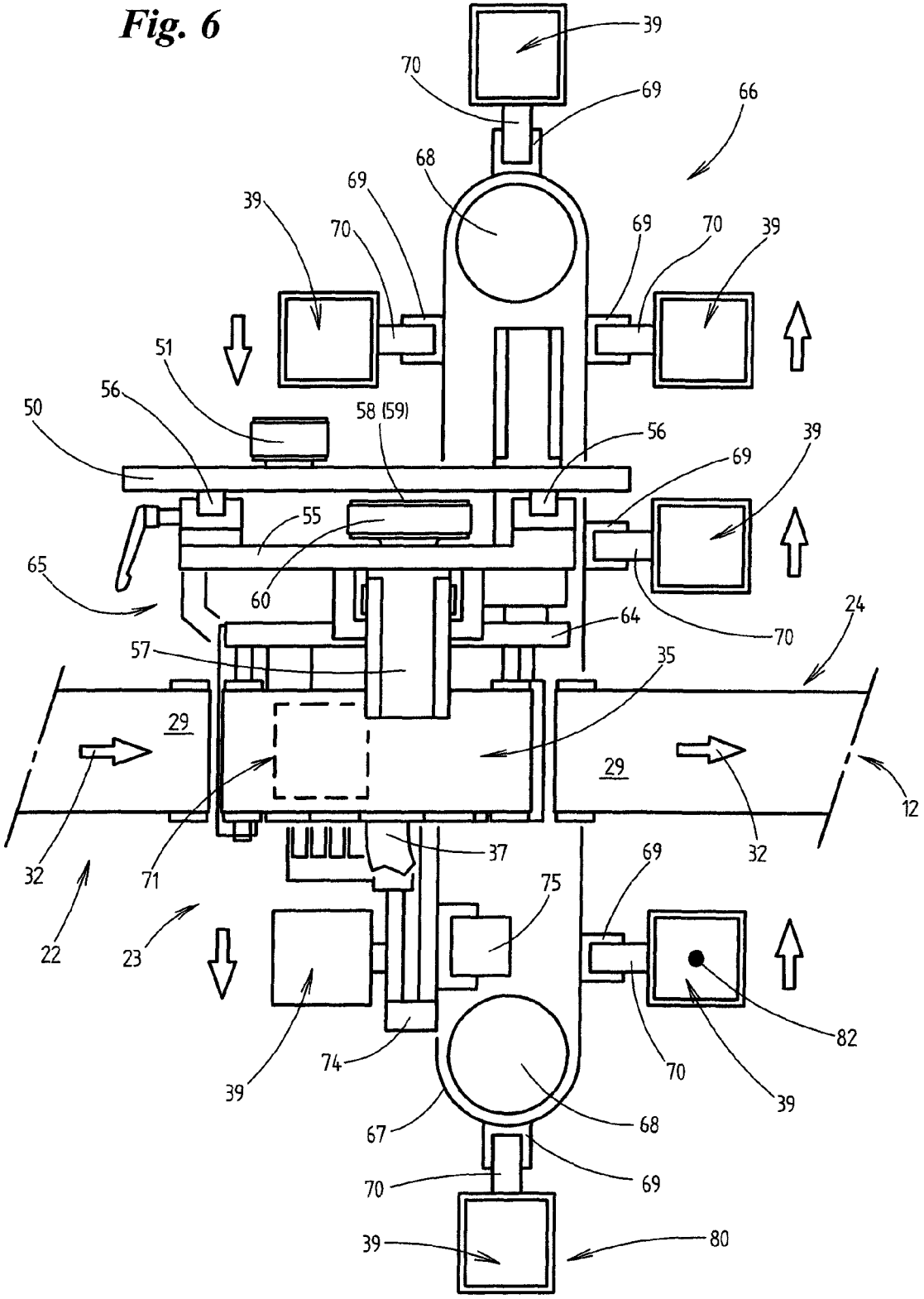
FIG. 6 shows a top view of an inlet station according to a second exemplary embodiment.
Figure 7:
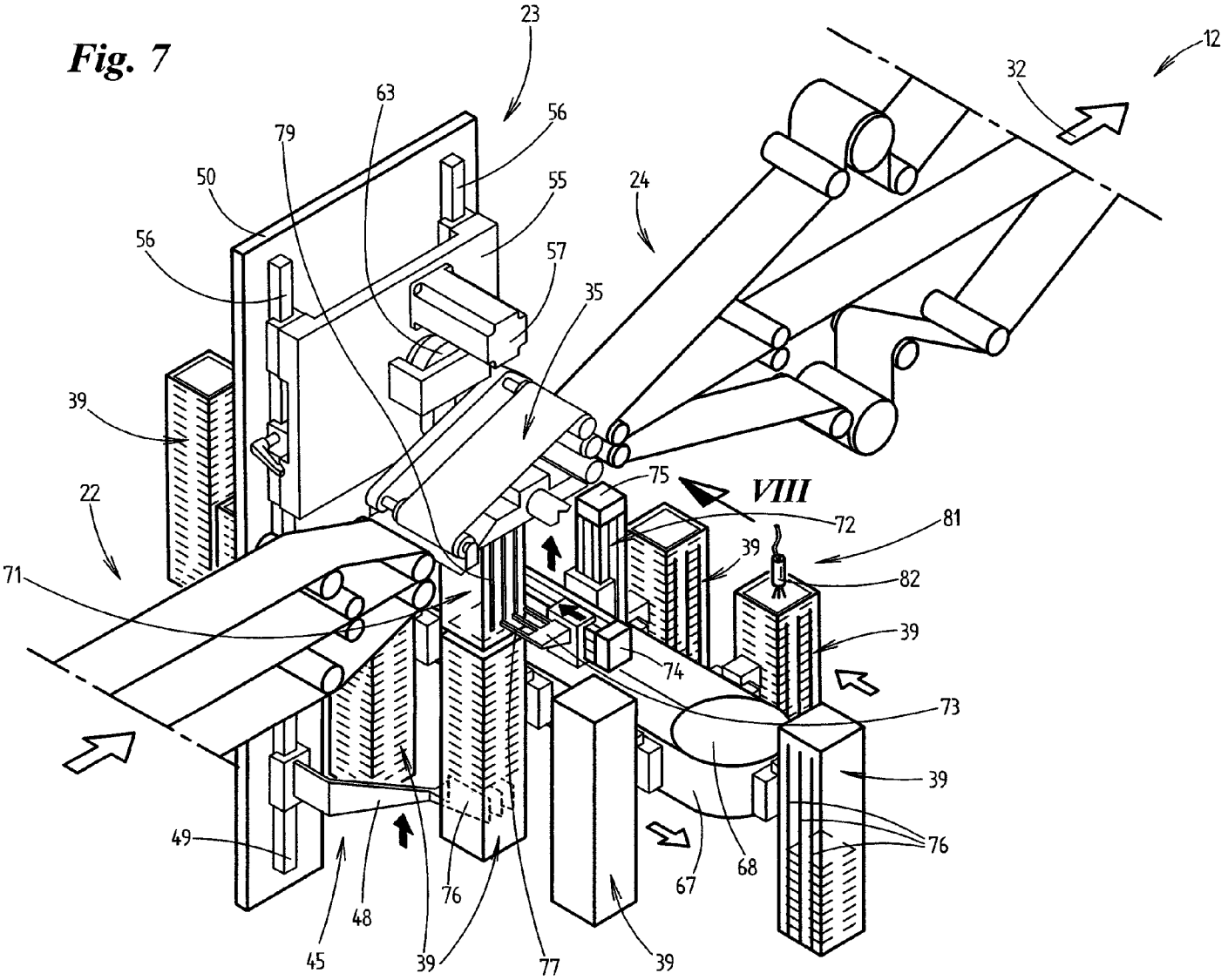
FIG. 7 shows a three-dimensional representation of the inlet station according to FIG. 6, FIGS. 8 and 9 show a side view of the inlet station according to arrow VIII in FIG. 7 during different phases of the supplying of the sanitary products

A characteristic is the functioning of the removal device 38 which is explained in particular by comparing FIGS. 3 and 5. As described in the introduction, for directing objects 10 through the inlet station 23 the conveyor run 34 of the suction belt 35 extends in the transport section 12, that is in the present case in a horizontal plane. To remove an object 10 from the hopper 39 and to introduce the same into the product flow in the transport section 12, the suction belt 35 or the conveyor run 34 thereof can be lowered in the direction of the top surface of the hopper 39 in order to grip the uppermost object 10 in the region of the removal opening 43 of the hopper 39 and to pull it out of the hopper 39.

In the present case, the entire suction belt 35 is pivoted about an axis. The axis is situated in the region of a lateral guide roller 53. As a result of pivoting the suction belt 35, its bottom conveyor run 34 is inclined downward in opposition to the transporting direction, namely approximately at an angle which corresponds to the angle of inclination of the objects 10. The conveyor run 34 is moved in the direction of the hopper 39 in this way in such a manner that the uppermost object 10 in the hopper 39 can be gripped and introduced into the product flow.

Once the object 10 has been removed from the hopper 39, the suction belt 35 is pivoted back such that after this a position according to FIG. 3 is once again assumed in which further objects 10 coming from the converter 11 are able to be directed through the inlet station 23. The pivoting movement of the suction belt 35 is also indicated by a double arrow 54 in FIG. 5.

An adjusting device 65 for pivoting the suction belt 35 is described below:

a support plate 55 is mounted on the support wall 50 by means of several running rails 56 so as to be displaceable in the vertical direction. The suction belt 35 can be positioned in the transport section 12 in this way. Two toothed wheels 58, 59, which are coupled together by means of a toothed belt 60, are driven by means of a drive 57. The toothed wheels 58, 59 are mounted on shafts 61, 62 which are guided through the support plate 55. A lowering lever 63 is mounted in an eccentric manner on the shaft 62 such that when the toothed wheel 59 is rotated, the lowering lever 63 is raised (FIG. 3) or lowered (FIG. 5). The lowering lever 63, in turn, is coupled with a smaller support plate 64 on which the guide rollers of the suction belt 35 are rotatably mounted. As can be seen from FIGS. 3 and 5, the lowering lever 63 is coupled with the support plate 64 approximately in the longitudinal center of the suction belt 35 such that said support plate can be pivoted about an axis of rotation in the region of the guide roller 53, which leads to the pivoting of the suction belt 35.

The device described so far operates as follows:

the objects coming from the converter 11 are transported along the transport section 12 in the direction of the filling member 13 and are put together in a grouping device which is not described in detail to form groups which are subsequently packaged in one of the packaging machines 15.

The grouping device for forming groups of objects can be associated with one of the packaging machines 15 or with the filling member 13. The grouping device is arranged downstream of the inlet station 23 and is placed such that the groups are formed before the objects 10 are packaged, that is, for example, into the bags 16. There are numerous examples in the prior art with regard to the design and method of operation of the grouping device. The present invention is not concerned with a specific design.

Insofar as necessary, individual objects 10 can be introduced into the packaging flow in the region of the inlet station 23. To this end, the suction belt 35 is moved into a position according to FIG. 5 and one or several objects 10 are removed from the hopper 39 and introduced into the packaging flow. The suction belt 35 is then moved back again into the position according to FIG. 5 such that objects 10 coming from the converter 11 can be directed through.

It is naturally also conceivable for objects 10 to be removed from the hopper 39 if the converter 11 is non-operational or is temporarily not delivering any objects 10 on account of a fault.

Objects 10 which correspond to the objects 10 which originate from the converter 11 can be situated in the hopper 39. However, it is also conceivable for them to be objects 10 which deviate from the objects 10 which originate from the converter 11, which comprise other characteristics, for example. In this way it would be possible to add one or several different objects 10 to a group of objects 10 in order to enable, for example, particular packaging compositions in this manner. Differently printed or colored sanitary products would be conceivable, for example, in order to give the pack contents an interesting appearance.

In addition, it is conceivable to use the inlet station 23 in order to replace objects 10 removed from the product flow. This can be necessary, for example, if individual objects 10 are removed for control purposes or are discharged on account of product faults. It is additionally conceivable for additional objects 10 to have to be introduced into the product flow on account of faults in the region of the packaging machine.

The following characteristics are to be taken into consideration from a control point of view:

when objects 10 are introduced into the product flow, the speeds of the members located upstream and/or downstream of the inlet station 23 have to be adapted. For example, slowing down the converter 11 and at the same time increasing the conveying speed of one, several or all of the conveyors 22, 24, 27, and 28 is conceivable. This is effected by means of the different control means 17, 19, 20.

In addition, it must also be possible to fill in gaps in the packaging flow by means of the control means 17, 19, 20. For example, it is conceivable for gaps in the product flow to be signaled by the machine control means 19 of the converter 11 and then to be compensated for by controlling the inlet station 23 in a corresponding manner. In such a case, the conveying speed of the conveyors 22, 24, 27, 28 may not have to be altered.

In addition, it is conceivable for one or several objects 10 to have to be separated out from the product flow in the region of the ejection unit 25. It would be conceivable in this case for the expected gap to be already filled beforehand by the control unit 17 in the region of the inlet station 23 or for an additional object 10 to be introduced which, as a result of controlling the conveyors 22, 24, 27, 28 in a corresponding manner, later takes the place of the discharged object 10.

In the event of the inlet station 23 serving for introducing different objects 10, the converter 11 can also be controlled such that the product flow comprises gaps into which the different objects 10 are then pushed in the inlet station 23. However, it is also conceivable for the packaging flow which comes from the converter 11 to be gap-free and for the gaps to be formed by controlling the conveyors 22, 24 in a corresponding manner and to be closed in the inlet station 23.

The aim of the control means is that the product flow is supplied regularly or in a gap-free manner to the grouping device. In the present case, the product flow is already gap-free in the region of the filling member 13.

Inside the hopper 39, the objects 10 are conveyed upward by means of the lifting device 45. It has been shown that it is advantageous when the travel of the lifting device 45 is controlled in dependence on the thickness of the objects 10. Said control can be effected by means of the control unit 17. The solution shown also has the advantage that the objects 10 are able to be pressed at a consistent pressure against the suction belt 35 by the lifting device 45 such that controlled removal is possible.

In addition, it has been shown that as a result of the inclined position of the cover 42, the topmost object 10 escapes slightly from the hopper 39 and can be gripped in a simple manner by the suction belt 35 and removed from the hopper 39. In this way, removing more than one object 10 at a time from the hopper 29 is also prevented.

The hopper 39 can be removed from the inlet station 23 and filled up at a position remote from the feed line.

A further exemplary embodiment of the invention is shown in FIGS. 6 to 13. Said exemplary embodiment differs from the preceding exemplary embodiment however simply with regard to the handling of the hoppers 39. Apart from that, the design of the inlet station 23 remains unchanged. This applies in particular to the suction belt 35 as removal device 38 and to the adjusting device 65. These are designed as in the first exemplary embodiment and function in a corresponding manner. Consequently, a description to this effect will not be repeated.

A characteristic of the second exemplary embodiment is that several hoppers 39 are arranged on a common conveying device 66 below the transport section 12. The conveying device 66 in the present case is an endless conveyor which runs round in the horizontal plane. In the exemplary embodiment shown, this is a belt conveyor, the conveyor belt 67 of which is guided around two guide rollers 68. Receiving means 69 for in each case one hopper 39 are provided at intervals on the outside of the conveyor belt 67. The hoppers 39 can be fastened in a releasable manner, for example by means of hooking, on the receiving means 69 by means of laterally arranged holders 70.

The conveying device 66 runs transversely with respect to the transport section 12.

The conveying device 66 is positioned in such a manner that the hoppers 39 are able to be positioned on the periphery of the conveyor belt 67 below the suction belt 35. An intermediate hopper 71 is situated there in this exemplary embodiment. The intermediate hopper 71 is preferably arranged fixed in position below the suction belt 35, like the hopper 39 in the case of the first exemplary embodiment. It has a cover 42 as in the first exemplary embodiment and a removal opening 43 for the removal of individual objects 10 by means of the suction belt 35. In addition, as in the first exemplary embodiment, a lifting device 45 is provided for transporting the objects 10 in a vertical direction in the hopper 39. A second lifting device 72 is provided additionally for transporting the objects 10 in the vertical direction in the intermediate hopper 71.

The second lifting device 72 has a lifting arm 73 for transporting the objects in the vertical direction in the intermediate hopper 71, namely until removal by means of the suction belt 35 in the region of the removal opening 43 of the intermediate hopper 71, as in the first exemplary embodiment.

The lifting arm 73 of the intermediate hopper 71 is movable in two directions by two drives. The details are described below by way of FIGS. 8 to 13. In the present case the drives are, on the one hand, a pneumatic cylinder 74 for moving the lifting arm 73 in the horizontal direction and a servo drive 75 for moving the lifting arm 73 in the vertical direction. In this case, the lifting arm 73 is coupled with the pneumatic cylinder 74 which, in turn, is coupled with the servo drive 75.

In contrast to the first exemplary embodiment, the lifting arm 48 of the lifting device 45 reaches through slot-like recesses 76 in a wall 41 of the hoppers 39 and grips the stack 40 of objects 10 in the hopper 39 at the bottom. To this end, the front free end of the support arm 46 is realized in a tine-like manner, the top surfaces of the tines 77 forming an inclined plane on which the bottommost object 10 rests and is aligned at a correspondingly slight angle.

As can be seen in particular in FIGS. 8 to 13, the intermediate hopper 71 and a respective hopper 39 are arranged flush one above the other. In this case, the intermediate hopper 71 and the respective hoppers 39 are open at the bottom or at the top such that the objects 10 can be moved out of the respective hoppers 39 into the intermediate hopper 71, namely by means of the lifting device 45. The objects 10 are then taken over by the lifting arm 73. In the present exemplary embodiment, the lifting arm 73 is also realized in a tine-like manner, the tines 78 moving into the intermediate hopper 71 through slot-like recesses 79 and gripping the bottommost object 10. The top surfaces of the tines 78 are also arranged in a suitable plane, like the tines 77.

Figure 9:
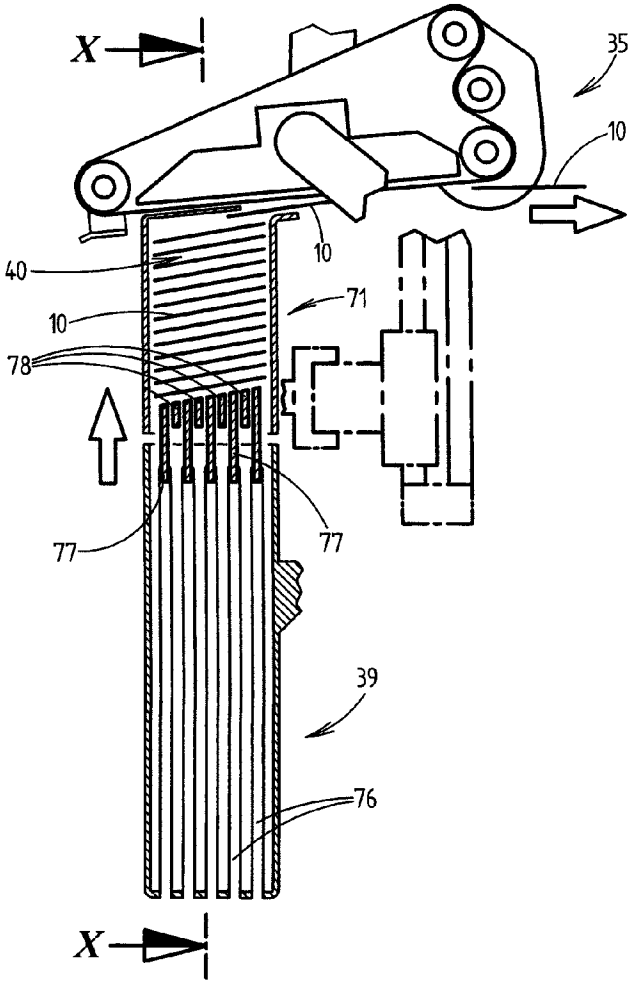
Figure 8:
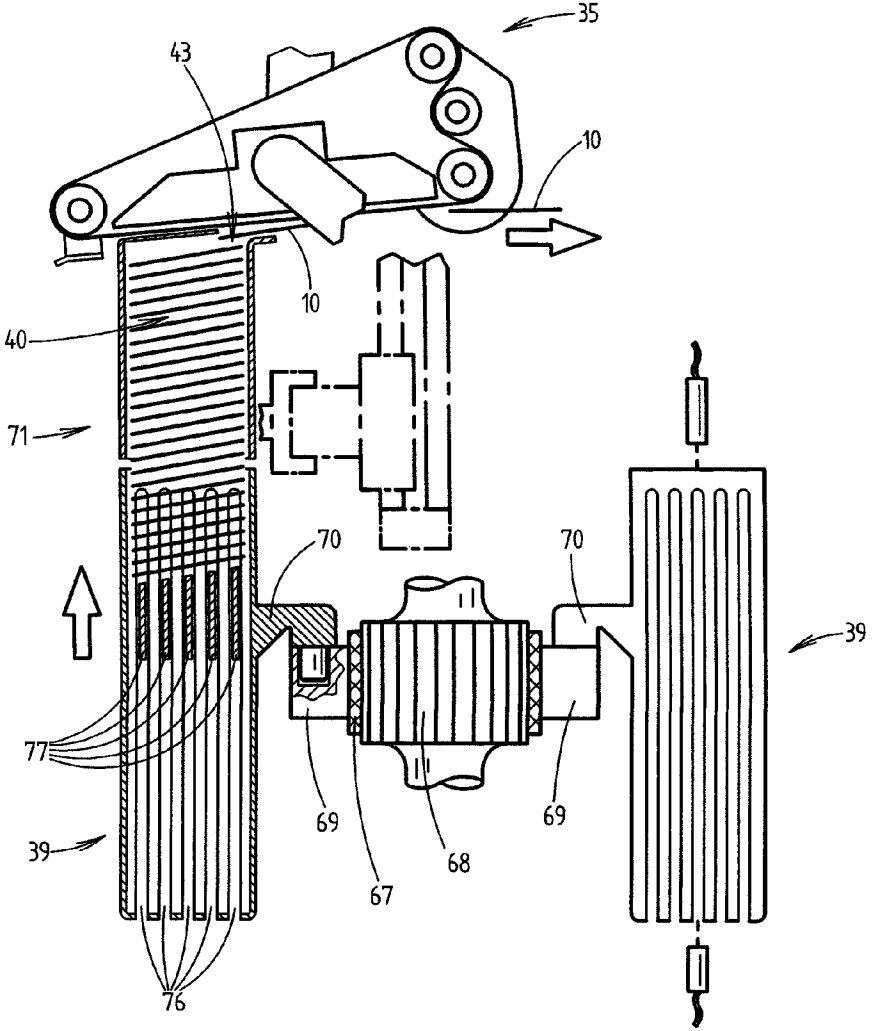
Figure 10:
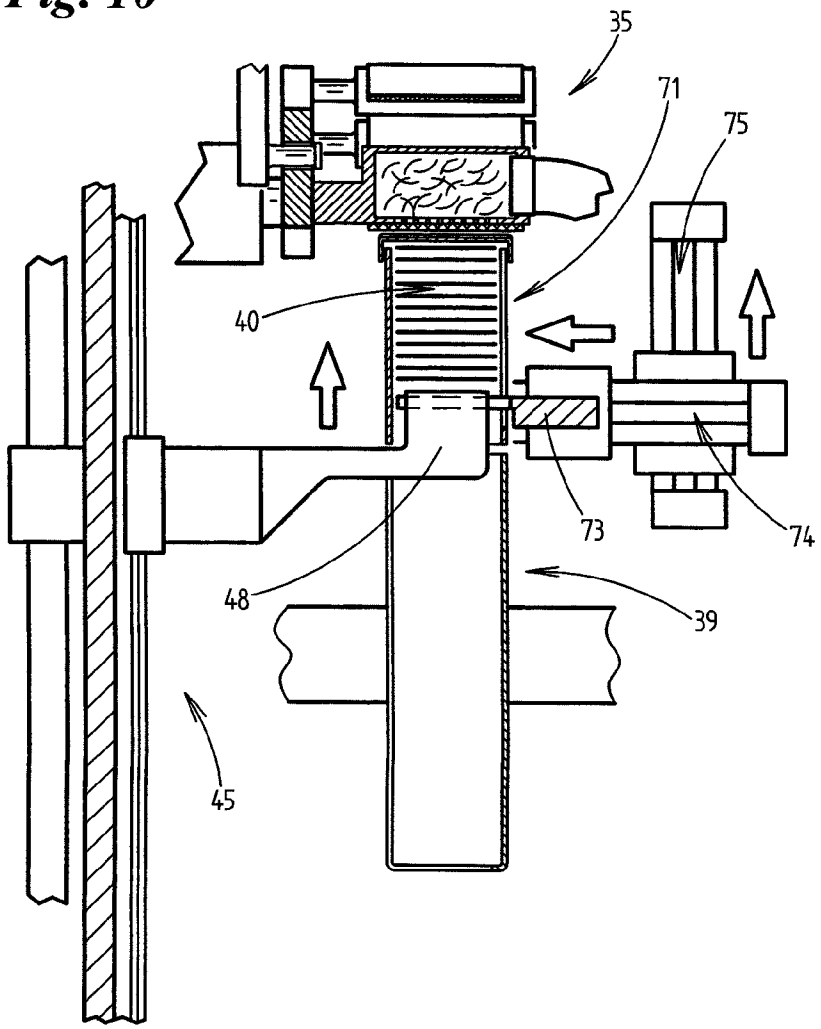
Figure 13:
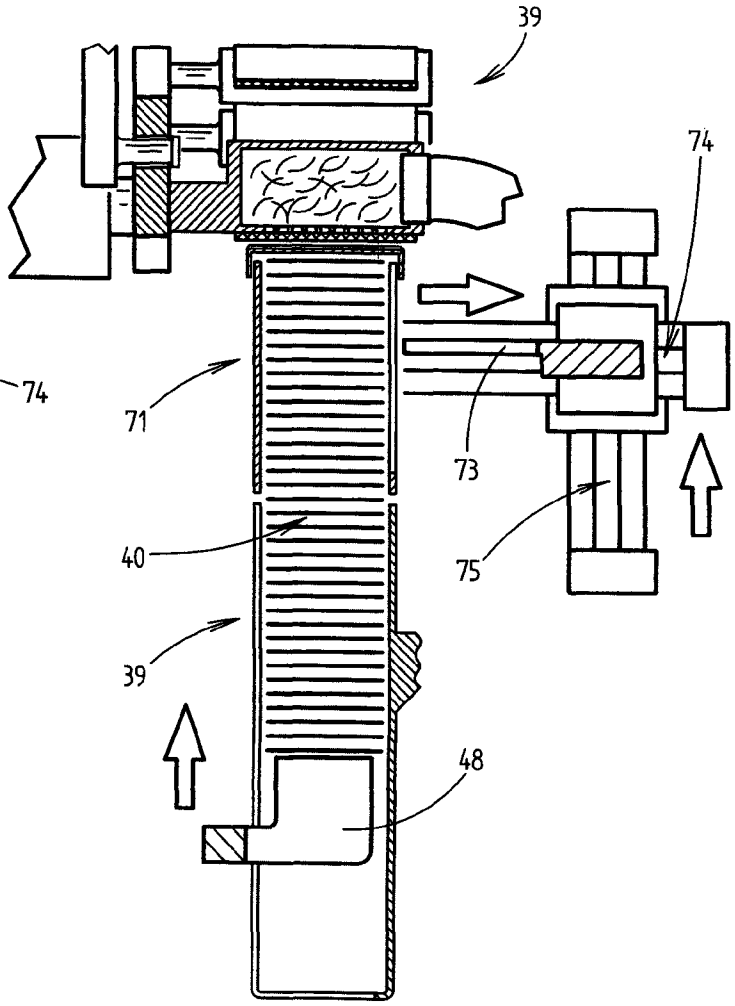

The device described so far functions as follows:

once a full hopper 39 has been moved below the intermediate hopper 71, the objects 10 are transported upward by means of the lifting device 45 or the lifting arm 48 until the topmost object 10 of the stack 40 is ready to be removed by the suction belt 35 in the region of the removal opening 43 (FIG. 8). The objects 10 are then gradually conveyed further upward by the lifting device 45 until the hopper 39 is emptied and the stack 40 can be taken over by the lifting arm 73 of the second lifting device 72 (FIG. 9 or FIG. 10). The tines 78 of the second lifting arm 73, in this case, are moved into the intermediate hopper 71 by means of the pneumatic cylinder 74 and are then moved upward by means of the servo drive 75 for conveying the objects 10 further.

Figure 11:
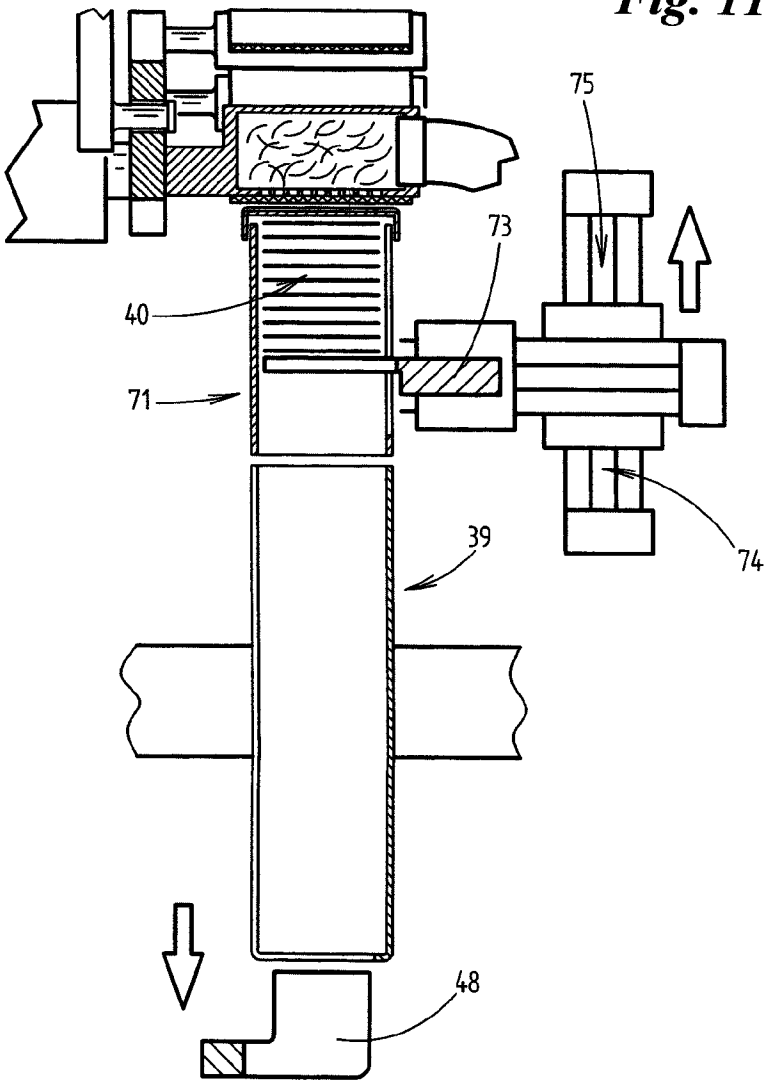
FIGS. 10 to 13 show a vertical section through the inlet station along the line of intersection X-X in FIG. 9 during different phases of the supplying of the sanitary products.
Figure 12:
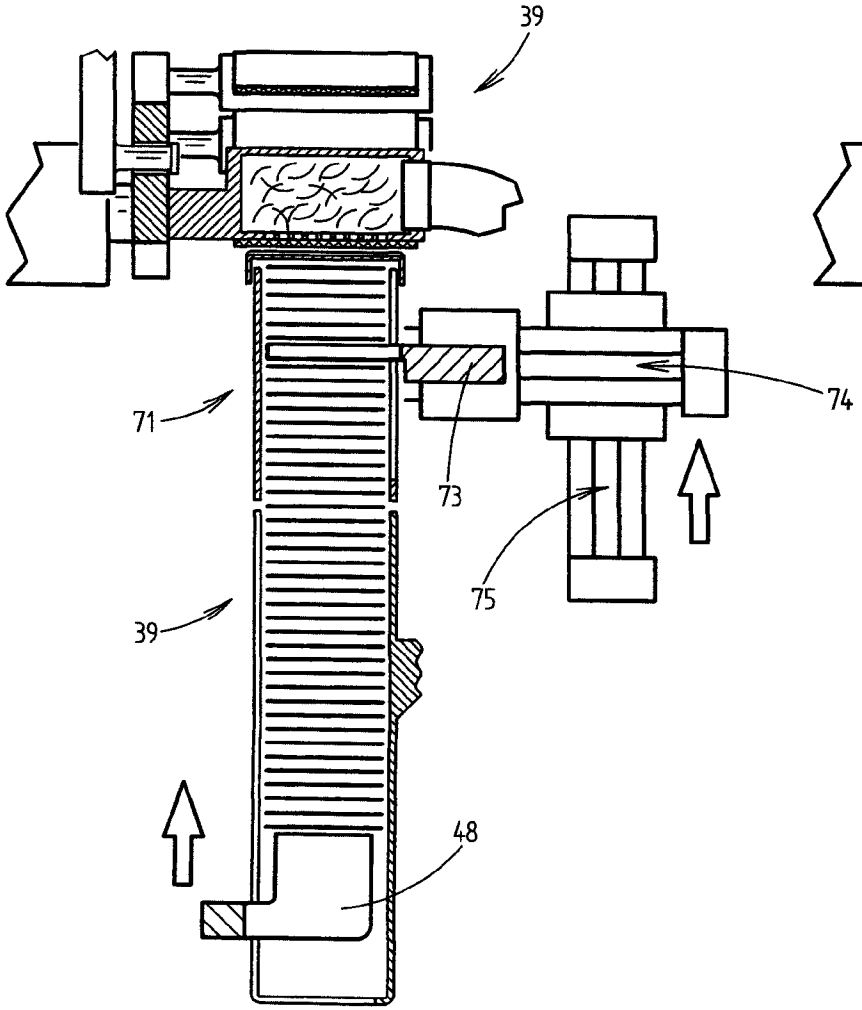

Once the stack 40 has been transferred to the second lifting device 72, the lifting arm 48 of the first lifting device 45 is moved out of the hopper 39 again (FIG. 11). The conveying device 66 is then moved further by one position such that the next filled hopper 39 is positioned below the intermediate hopper 71. The lifting arm 48 is then introduced once again into the hopper 39 and the objects 10 are raised and transported upward until the intermediate hopper 71 is completely filled again (FIG. 12). The lifting arm 73 of the second lifting device 72 can then be moved out of the intermediate hopper 71 again (FIG. 13) and the entire stack 40 is transported further by means of the lifting arm 48 of the first lifting device 45 (FIG. 8).

The cycle so far described is repeated continuously such that it is not necessary to interrupt the production in order to transfer a new filled hopper 29 into the inlet station 23. The time necessary to exchange an empty hopper 39 for a full hopper is able to be bridged by the intermediate hopper 71.

The filling of the emptied hoppers 39 is effected in a filling station 80. In one of the following stations, a test can be run by means of a test device 81, in particular a sensor 82, as to whether there are objects 10 situated in the hoppers 39. If this is not the case, the control unit 17 can control the conveying device 66 such that the non-filled hopper 29 is not stopped below the intermediate hopper 71, but only the filled hopper 39 following next.

The empty or filled hoppers 29 can be filled, cleaned or stored outside of the conveying device 66.

As an alternative to this, it is naturally conceivable not to remove the hoppers 39 from the conveying device 66 for filling.

It is also conceivable over and above this to use an intermediate hopper 41 without a conveying device 66 located below it for the hoppers 39. For example, it would be conceivable for the hoppers 29 to be hooked-in and exchanged manually below the intermediate hopper 71.

LIST OF REFERENCES

10 Object
11 Converter
12 Transport section
13 Filling member
14 Feed conveyor
15 Packaging machine
16 Bag
17 Control unit
18 Control line
19 Machine control means
20 Control device
22 Conveyor
23 Inlet station
24 Conveyor
25 Ejection unit
26 Collecting container
27 Conveyor
28 Conveyor
29 Conveyor run
30 Conveyor run
31 Guide rollers
32 Arrow
33 Conveyor
34 Conveyor run
35 Suction belt
36 Vacuum chamber
37 Vacuum connection
38 Removal device
39 Hopper
40 Stack
41 Wall
42 Cover
43 Removal opening
44 Lifting part
45 Lifting device
46 Support arm
47 Pneumatic cylinder
48 Lifting arm
49 Running rail
50 Support wall
51 Toothed belt
52 Bottom wall
53 Guide roller
54 Double arrow
55 Support plate
56 Running rail
57 Drive
58 Toothed wheel
59 Toothed wheel
60 Toothed belt
61 Shaft
62 Shaft
63 Lowering lever
64 Support plate
65 Adjusting device
66 Conveying device
67 Conveyor belt
68 Guide roller
69 Receiving means
70 Holder
71 Intermediate hopper
72 Lifting device
73 Lifting arm
74 Pneumatic cylinder
75 Servo drive
76 Recess
77 Tine
78 Tine
79 Recess
80 Filling station
81 Test device
82 Sensor

What is claimed is:

1. A method for handling flat objects (10), comprising:

conveying the objects (10) along a transport section (12) in a product flow and then putting the objects (10) together in a grouping station to form groups of the objects (10); and introducing the objects (10) into the product flow in the region of an inlet station (23) before the objects (10) are put together to form groups, wherein the objects (10) are made available in a hopper (39, 71) in the region of the inlet station (23) and are removed from said hopper and introduced into the product flow, wherein a removal device (38) for removing the objects (10) from the hopper (39, 71) is arranged in the region of the inlet station (23) above the hopper (39, 71) or above a removal opening (43) of the hopper (39, 71), wherein the removal device (38) for removing the objects (10) from the hopper (39, 71) is a suction belt (35), and wherein to remove one of the objects (10) from the hopper (39, 71), the removal device (38) is lowered at least in part by means of an adjusting device (65) and is raised again after the removal of the one of the objects (10) from the hopper (39, 71).

2. The method as claimed in claim 1, wherein the objects (10) are moved upward in the hopper (39, 71) by means of a lifting device (45, 72), wherein the lifting device (45, 72) is controlled by a control unit (17) in dependence on the thickness of the objects (10), and the objects (10) are removed from the top of the hopper (39, 71) which is situated below the transport section (12).

3. The method as claimed in claim 1, wherein objects (10) that are identical to and/or different from the objects (10) that are already situated in the product flow are introduced in the region of the inlet station (23).

4. A method for handling flat objects (10), comprising:

conveying the objects (10) along a transport section (12) in a product flow and then putting the objects (10) together in a grouping station to form groups of the objects (10); and introducing the objects (10) into the product flow in the region of an inlet station (23) before the objects (10) are put together to form groups, wherein several hoppers (39) are associated with one conveying device (66), and are moved one after another into the region of the inlet station (23) and there are emptied by introducing the objects (10) from the hoppers (39) into the product flow.

5. The method as claimed in claim 4, wherein objects (10) that are identical to and/or different from the objects (10) that are already situated in the product flow are introduced in the region of the inlet station (23).

6. The method as claimed in claim 4, wherein the conveying device (66) is an endless conveyor with receiving means (61) for a plurality of the hopper (39).

7. A method for handling flat objects (10), comprising:

conveying the objects (10) along a transport section (12) in a product flow and then putting the objects (10) together in a grouping station to form groups of the objects (10); and introducing the objects (10) into the product flow in the region of an inlet station (23) before the objects (10) are put together to form groups, wherein conveying or production speeds of individual or several members in the transport section (12) are adapted by at least one control means (17, 19, 20) in the inlet station (23) for introducing the objects (10), and wherein at least one of (a) the production speed of a converter (11) is reduced and (b) the conveying speed of a conveyor (22, 24, 27, 28) is increased to introduce the objects (10) into a gap in the product flow.

8. The method as claimed in claim 7, wherein objects (10) that are identical to and/or different from the objects (10) that are already situated in the product flow are introduced in the region of the inlet station (23).

9. A device for handling flat objects (10), said device comprising;

a transport section (12) for transporting the objects (10) in a product flow in the direction of a grouping station for forming groups of the objects (10);

an inlet station (23) for introducing the objects (10) into the product flow is provided along the transport section (12) and at a spacing from the grouping station;

a hopper (39, 71); and a lifting device (45, 72), wherein the hopper (39, 71) is provided with the objects (10) in the region of the inlet station (23), from the top of which hopper said objects are removable, and the lifting device (45, 72) is provided for transporting the objects (10) inside the hopper (39, 71), wherein the hopper (39, 71) is closed in part at the top by a cover (42) and a removal opening (43) for objects (10) is formed outside the cover (42), and wherein at least one of the cover (42) and the objects (10) is arranged at a slight angle.

10. The device as claimed in claim 9, further comprising a removal device (38) arranged in the region of the transport section (12) above the hopper (39, 71), wherein, to remove one of the objects (10), the removal device (38) is lowerable at least in part to grip one of the objects (10) that projects in part from the removal opening (43).

11. The device as claimed in claim 10, wherein the removal device (38) is a suction belt (35).

12. The device as claimed in claim 9, further comprising a conveying device, wherein several hoppers (39) are associated with the conveying device and are transportable one after another into the inlet station (23) for emptying the hoppers (39), wherein an intermediate hopper (71) is arranged in the inlet station (23) above the hopper (39), wherein the objects (10) are initially transportable by the lifting device (45) into the region of the intermediate hopper (71) and wherein the objects (10) can be supplied to the removal device (38) from the intermediate hopper (71) by means of a further lifting device (72) whilst the empty hopper (39) is replaced by a filled hopper (39).

13. The device as claimed in claim 12, wherein the hoppers (39) are testable by means of a testing device (81) for the presence of the objects (10), wherein the conveying device (66) is controllable in such a manner by means of a control unit (17) whereby only hoppers (39) with the objects (10) are held ready in the inlet station (23) for the removal of the objects (10).

14. The device as claimed in claim 12, wherein the hoppers (39) are releasably fastenable on the conveying device (66) for filling the hoppers (39) with the objects (10), for cleaning the hoppers (39), and for stocking the hoppers (39) outside the conveying device (66).

* * * * *